United States Patent [19]

Arisato

[11] 4,433,268

[45] Feb. 21, 1984

[54] DEFLECTION YOKE FOR A COLOR CATHODE RAY TUBE

[75] Inventor: Junichi Arisato, Fukaya, Japan

[73] Assignee: Tokyo Shibaura Denki Kabushiki Kaisha, Tokyo, Japan

[21] Appl. No.: 275,156

[22] Filed: Jun. 19, 1981

[30] Foreign Application Priority Data

Aug. 20, 1980 [JP] Japan ..... 55-114523

[51] Int. Cl.[3] ..... H01F 3/12

[52] U.S. Cl. ..... 313/440; 335/211

[58] Field of Search ..... 313/440; 335/211, 210

[56] References Cited

U.S. PATENT DOCUMENTS

| | | | |
|---|---|---|---|
| 4,143,345 | 3/1979 | Barkow | 335/210 X |
| 4,217,566 | 8/1980 | Hamano et al. | 335/210 X |
| 4,231,009 | 10/1980 | Barkow | 335/210 |
| 4,257,023 | 3/1981 | Kamijo | 335/211 |

OTHER PUBLICATIONS

"DPC-Free Color Picture Tube," by Taketoshi Shimona et al., *Toshiba Review*, vol. 34, No. 4, pp. 348-351, Apr., 1979.

"Development of a Full Pincushion Free Deflection Yoke for 110 Degree Color CRT" by Eiji Tamaki et al., of Toshiba Corp., Television Gatsukai Gijutsu Houkoku (Televigatsu-Gi-Ho, vol. 4, No. 13, pp. 1-6, published Aug. 28, 1980.

*Primary Examiner*—Palmer C. Demeo

*Attorney, Agent, or Firm*—Schuyler, Banner, Birch, McKie & Beckett

[57] ABSTRACT

A deflection yoke for a color cathode ray tube is disclosed which does not cause raster distortion and avoids electron beam convergence error. Both horizontal and vertical deflection coils generate fields having a pincushion distribution. Front end magnetic members extend the pincushion type vertical deflection magnetic field toward the viewing screen of the tube. Rear end magnetic members deform one portion of the magnetic field generated by the vertical deflection coils into a barrel type so that the sum of the vertical deflection magnetic field is effectively a barrel type distribution.

6 Claims, 9 Drawing Figures

DEFLECTION YOKE FOR A COLOR CATHODE RAY TUBE

BACKGROUND OF THE INVENTION

This invention relates an improved deflection yoke for a color cathode ray tube.

It has been proven by experiment that a deflection yoke for a color cathode ray tube with in-line or delta electron gun assemblies can be formed which generates a pincushion distribution vertical deflection magnetic field to correct the right and left side distortion of the raster. This deflection yoke also can be formed to generate a pincushion distribution horizontal deflection magnetic field to correct the upper and lower side distortion of the raster. Raster distortion is largely dependent on the magnetic field generated at the portion of the deflection yoke which corresponds to the cone portion of the cathode ray tube. It is also well understood that, in order to prevent three electron beams from causing convergence error, the sum of the vertical deflection magnetic field generated in the vicinity of the deflection yoke, which corresponds to the area between the neck and cone portions of the cathode ray tube, must be a barrel distribution. On the contrary, the sum of the horizontal deflection magnetic field must be a pincushion distribution.

The prior art deflection yoke of the so-called self-convergence type is formed to generate a barrel distribution in the vertical deflection field and a pincushion distribution in the horizontal deflection magnetic field. In such yoke, satisfactory convergence characteristics of electron beams and correction of upper and lower side pincushion distortion of the raster can be obtained. However, distortion of the right and left side pincushion of the raster is increased.

At the present time, in order to correct the right and left side pincushion distortion of the raster, a correcting circuit is used to produce an output signal in synchronism with a vertical signal. The output signal has an amplitude which varies in a parabolic form and the signal is superimposed on the horizontal deflection signal. However, such a correcting circuit adds components, increases cost and increases the complexity of the construction.

SUMMARY OF THE INVENTION

Accordingly, an object of the present invention is to provide an improved deflection yoke which does not cause raster distortion and provides satisfactory electron beam convergence characteristics.

According to the present invention, a deflection yoke includes a substantially cylindrical core disposed around the outer periphery of a cathode ray tube. A pair of horizontal deflection coils is disposed between the tube and the core for generating a pincushion distribution horizontal deflection magnetic field. A pair of vertical deflection coils are wound around the core and face each other for generating a pincushion distribution vertical deflection magnetic field. Magnetic members are disposed at the large diameter end of the core for picking up leakage fluxes caused by the vertical deflection coils. These magnetic members extend the pincushion distribution vertical deflection magnetic field toward the screen side of the tube. Additional magnetic members are disposed at the small diameter end of the core to deform one portion of the vertical deflection magnetic field into a barrel distribution.

The objects and advantages of the present invention will become apparent to persons skilled in the art from a study of the following description of the accompanying drawings.

DESCRIPTION OF THE PREFERRED EMBODIMENT

Figure 1:
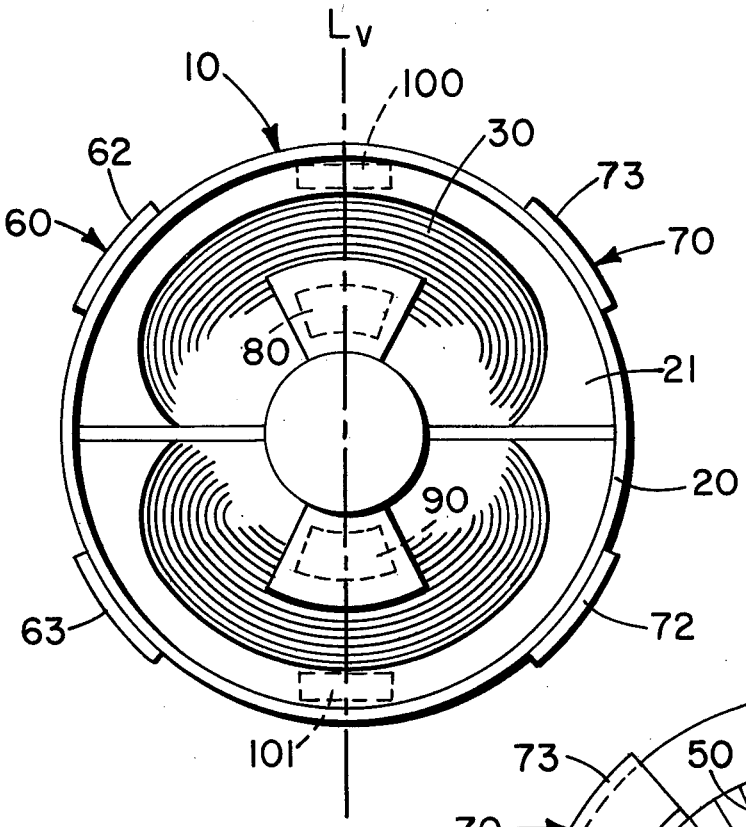
FIG. 1 is a front view of a deflection yoke according to the present invention.
Figure 2:
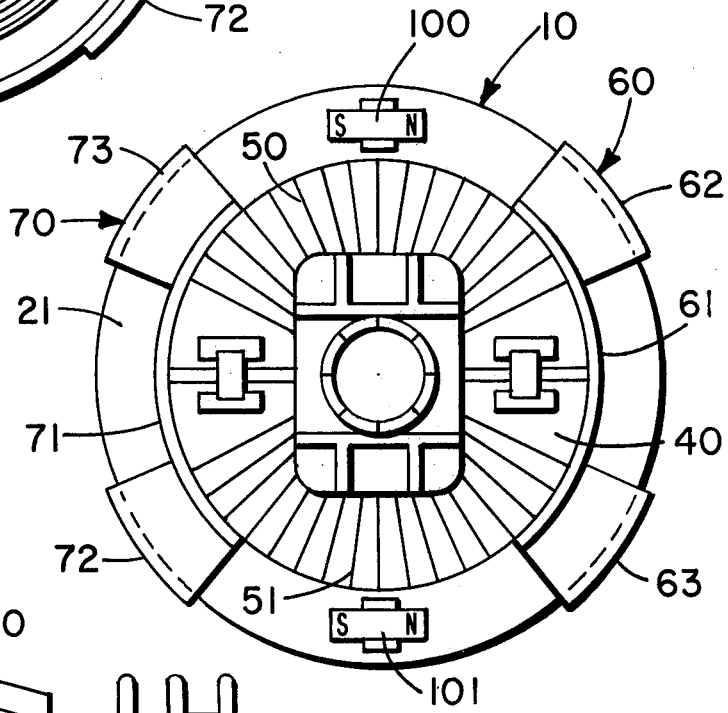
FIG. 2 is a rear view of the deflection yoke according to the present invention.
Figure 3:
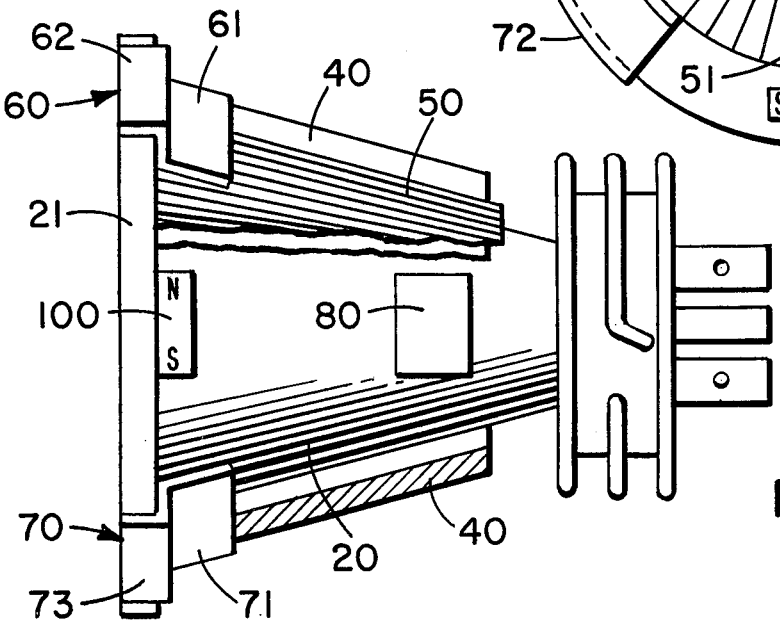
FIG. 3 is a partially cutaway side view of the deflection yoke of the present invention.
Figure 4:
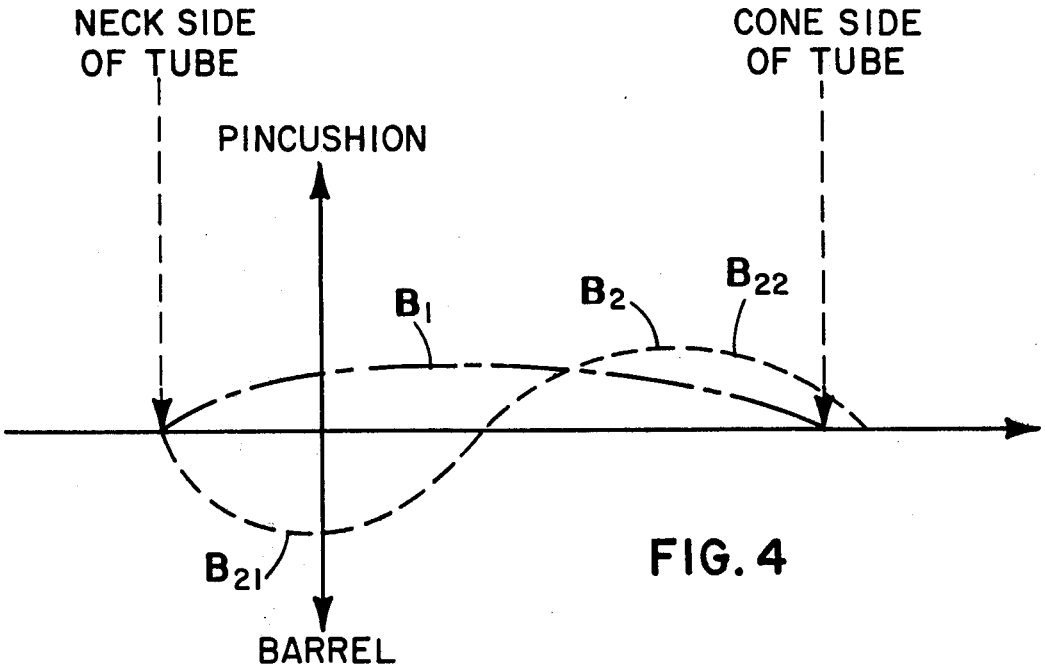
FIG. 4 is a graph of the vertical deflection magnetic field distribution which is generated by the deflection yoke.

A deflection yoke 10 according to the present invention is shown in FIGS. 1 to 3 and a graph of the vertical deflection magnetic field distribution of deflection yoke 10 is shown in FIG. 4. The pair of saddle-shaped horizontal deflection coils 30 are disposed at the interior periphery of a funnel shaped coil separator 20. The coil separator 20 is disposed around the outer periphery of a color cathode ray tube (not shown). Horizontal deflection coils 30 generate a horizontal deflection magnetic field having a pincushion distribution. A substantially cylindrical core 40 is located around the outer periphery of separator 20. A pair of vertical deflection coils 50 and 51 are wound in a toroid around the upper and lower parts of core 40. The width of vertical deflection coils 50 and 51 is narrow in order to generate a vertical deflection magnetic field having a pincushion distribution as shown by the dotted line $B_1$ in FIG. 4.

Figure 5:
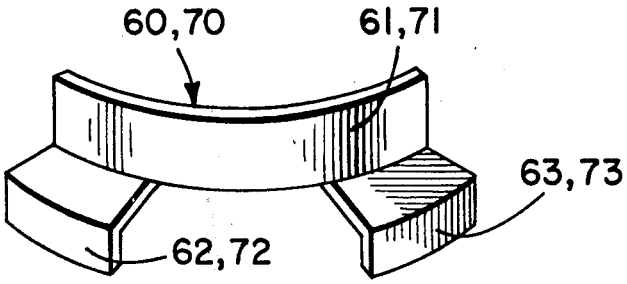
FIG. 5 is a perspective view of a front magnetic member used in the deflection yoke.

A pair of front end magnetic members 60 and 70 are attached to the large diameter end of core 40. Since these magnetic members 60 and 70 are identical, only one of these front end magnetic memebers is shown in FIG. 5 with duplicate numerals indicating the corresponding part numbers for the two different magnetic members 60 and 70. As shown in FIG. 5, the front end magnetic members 60 and 70 have curving bars 61 and 71 which have substantially the same curvature as the large diameter end of the outer periphery of core 40. Thus, these curving bars 61 and 71 fit on core 40. Curving bars 61 and 71 of each front end magnetic member 60 and 70 cross the side of core 40 in the vicinity of vertical deflection coils 50 and 51. Each magnetic member 60 and 70 also includes a pair of arms 62 (72) and 63 (73) at opposite ends of the curving bars 61 and 71. Each arm 62 and 63 is at a substantially right angle to curving bar 61 and the end of each arm 62 and 63 is bent to fit on a flange 21 on the large diameter side of separator 20. When both front end magnetic members 60 and 70 are attached to the large diameter end of the outer periphery of core 40, their arms 62, 63, 72 and 73 substantially correspond to the four corners of the cathode ray tube.

Leakage flux from vertical deflection coils 50 and 51 is picked up by front end magnetic members 60 and 70. For example, leakage flux may be picked up by curving bar 61 of front end magnetic member 60 and passed from arms 62 and 63 of member 60 to arms 72 and 73 of member 70. The magnetic field between the arms 62 and 63 of member 60 and arms 73 and 72 of member 70 is synchronized with the vertical deflection magnetic field generated by vertical deflection coils 50 and 51, which is distributed in pincushion form. As a result, the pincushion vertical deflection magnetic field is extended toward the screen side of the cathode ray tube as shown by dotted line $B_{22}$ in FIG. 4 because the arms of each front end magnetic member 60 and 70 extend toward the screen of the tube.

Figure 6:
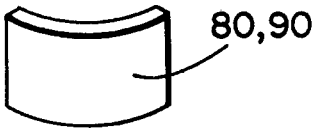
FIG. 6 is a perspective view of a rear magnetic member used in the deflection yoke.

Each pair of rear end magnetic members 80 and 90 is attached to the outer periphery of separator 20 under the small diameter end of core 40. Rear end magnetic members 80 and 90 are also positioned under each vertical deflection coil 50 and 60 and face each other. As shown in FIG. 6, each rear end magnetic member 80 and 90 has substantially the same curvature as the outer periphery of the portion of separator 20 which corresponds to the small diameter end of core 40. The reluctance of rear end magnetic members 80 and 90 is smaller than that of air so the magnetic fluxes generated by the vertical deflection coils tend to pass in the vicinity of rear end magnetic members 80 and 90. Therefore, the magnetic fluxes generated by vertical deflection coils 50 and 60 deflect toward the inner periphery of core 40. In other words, the vertical deflection magnetic field is in the form of a barrel distribution at the small diameter end of core 40, as shown by dotted line $B_{21}$ in FIG. 4.

In summary, the vertical deflection magnetic field due to yoke 10 is in the form of a pincushion distribution at the cone side of the tube; however, its total sum $B_2$ (see FIG. 4) forms a barrel distribution. The horizontal deflection magnetic field generated by horizontal deflection coils 30 is in the form of a pincushion distribution, as mentioned above. Accordingly, yoke 10 does not cause raster distortion and convergence error.

Figure 7A:
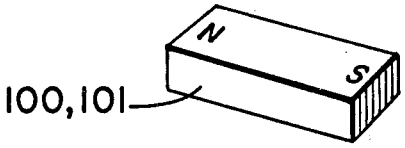
FIGS. 7(*a*) and (*b*) are perspective views of the deflection yoke.
Figure 7B:
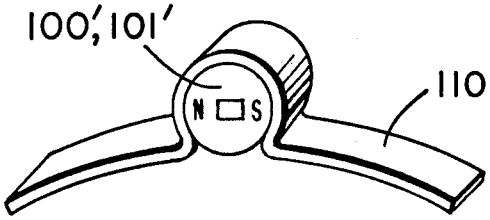
Figure 8:
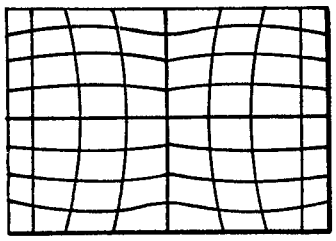
FIG. 8 is an illustration of the raster distortion.

Furthermore, a pair of plate type permanent magnets 100 and 101, which are shown in FIG. 7(*a*), are attached to the upper and lower portions of the rear of flange 21 on the vertical center line $L_v$ of yoke 10. When the deflection angle of the cathode ray tube increases, the raster normally develops a wave shaped distortion (the so-called sea gull distortion) in the horizontal direction and an inside distortion in the vertical direction, as shown in FIG. 8. The magnetic fields generated by magnets 100 and 101 correct the above distortions and improve the linearization of the raster. As a substitution for magnets 100 and 101, a pair of pole shaped permanent magnets 100' and 101' may be mounted on flange 21 of separator 20 by a hump shaped attachment 110 shown in FIG. 7(*b*).

The above deflection yoke 10 can be easily fabricated without the necessity for fine adjustments. The vertical deflection coils 50 and 51 also are simple to wind and construct. Finally, the deflection yoke 10 need not be modified or adjusted in accordance with the deflection angle of the cathode ray tube on which it is used.

Although an illustrative embodiment of the invention has been described in detail with reference to the accompanying drawings, it is to be understood that the invention is not limited to the precise embodiment and that various changes and modifications may be effected therein by one skilled in the art without departing from the scope or spirit of the invention.

I claim:

1. A deflection yoke for a color cathode ray tube having a substantially rectangular screen comprises:

a substantially cylindrical core surrounding said tube;

a pair of horizontal deflection coils between said tube and said core for generating a horizontal deflection magnetic field having a pincushion distribution;

a pair of vertical deflection coils wound around said core and facing each other for generating a vertical deflection magnetic field having a pincushion distribution;

front end magnetic members mounted at the large diameter end of said core; said members having arms at positions which substantially correspond to the corners of said screen of said tube; and a pair of rear end magnetic members mounted between said tube of said vertical deflection coils and at the small diameter end of said core, said rear end magnetic members facing each other for deforming a portion of the vertical deflection magnetic field into a barrel distribution.

2. The deflection yoke of claim 1 wherein each of said front end magnetic members includes a magnetic curving bar arranged across the facing end of said vertical deflection coils, each of said front end magnetic members further having two of said arms mounted on opposite ends of said curving bars.

3. The deflection yoke of claim 2 wherein said arms extend toward the four corners of said screen.

4. The deflection yoke of claim 1 further comprising a pair of permanent magnets mounted at the large diameter end of said core and substantially on the vertical center line of said tube, said permanent magnets facing each other.

5. A deflection yoke for a cathode ray tube having a viewing screen comprising:

a substantially cylindrical core surrounding said tube;

a pair of horizontal deflection coils between said tube and said core for generating a horizontal deflection magnetic field having a pincushion distribution;

a pair of vertical deflection coils wound around said core and facing each other for generating a vertical magnetic field having a pincushion distribution;

front end magnetic means mounted at the large diameter end of said core for picking up leakage flux caused by said vertical deflection coils and extending the pincushion type vertical deflection magnetic field toward said screen of said tube; and rear end magnetic means mounted at the same diameter end of said core for deforming one portion of the vertical deflection magnetic field into a barrel distribution.

6. The deflection yoke of claim 5 further comprising a pair of permanent magnets mounted at the large diameter end of said core and facing each other.

* * * * *